US005170767A

United States Patent [19]

Wada et al.

[11] Patent Number: 5,170,767

[45] Date of Patent: Dec. 15, 1992

[54] IGNITION COIL FOR INTERNAL COMBUSTION ENGINE

[75] Inventors: Jyun-ichi Wada, Aichi; Yoshimi Nakase, Anjo; Tetsuya Miwa, Nagoya, all of Japan

[73] Assignee: Nippondenso Co., Ltd., Kariya, Japan

[21] Appl. No.: 663,159

[22] Filed: Mar. 1, 1991

[30] Foreign Application Priority Data

Mar. 8, 1990 [JP] Japan ..... 2-57429
Mar. 14, 1990 [JP] Japan ..... 2-63483

[51] Int. Cl.[5] ..... H01H 27/28; F02P 15/00

[52] U.S. Cl. ..... 123/633; 29/605; 29/748; 123/169 PA; 123/634; 336/192; 336/96

[58] Field of Search ..... 123/633, 634, 635, 169 PA; 336/96, 192, 205; 29/605, 748

[56] References Cited

U.S. PATENT DOCUMENTS 4,740,773 4/1988 Buchschmid et al. ..... 336/96
5,038,745 8/1991 Krappel et al. ..... 123/634 X

FOREIGN PATENT DOCUMENTS 2624559 6/1989 France .
51-137041 11/1976 Japan .
64-8580 1/1989 Japan .
2200258 7/1988 United Kingdom .

*Primary Examiner*—Tony M. Argenbright
*Attorney, Agent, or Firm*—Cushman, Darby & Cushman

[57] ABSTRACT

Disclosed is an ignition coil for an internal combustion engine, which comprises a coil portion including a primary winding and a bobbin around which a secondary winding is wound, a resin case for accommodating the coil portion, a conductive secondary auxiliary terminal fixed to the flange of the bobbin and around which the end portion of the secondary winding is twined, a conductive secondary terminal confronting with the winding portion of the bobbin and assembled to the secondary auxiliary terminal, and a high tension voltage terminal connected to the secondary terminal for supplying a secondary high tension output to the outside.

11 Claims, 9 Drawing Sheets

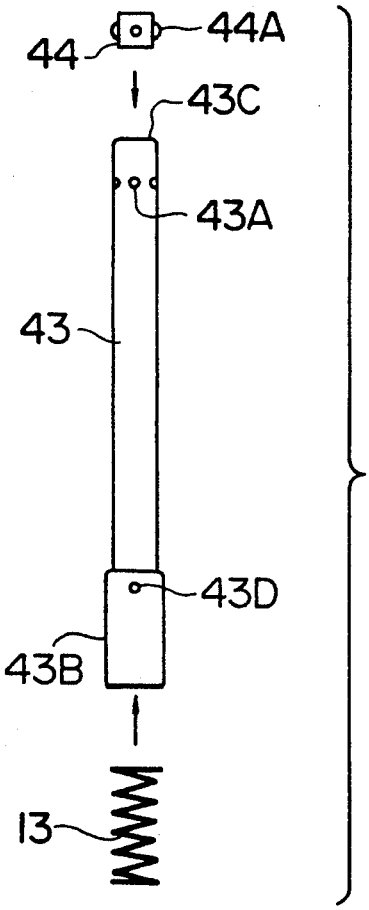
FIG. 11
FIG. 12
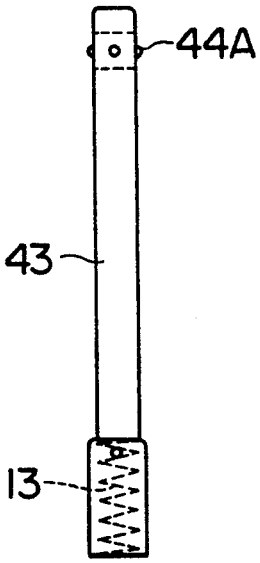

IGNITION COIL FOR INTERNAL COMBUSTION ENGINE

BACKGROUND OF THE INVENTION

The present invention relates to an ignition coil for an internal combustion engine, and more specifically, to the structure of a secondary terminal portion to which the end portion of a secondary winding is connected.

Conventionally, there is an ignition coil for an internal combustion engine having a secondary winding the end portion of which is soldered to a conductive secondary terminal disposed on the lower surface of the winding portion of a bobbin to externally output a high tension voltage through a high tension voltage terminal.

In the aforesaid conventional ignition coil for an internal combustion engine, since the secondary terminal, to which the end portion of the secondary winding is connected, is disposed on the lower surface of the winding portion of the bobbin, the secondary terminal is obstructive when winding is carried out. The secondary terminal must be assembled to the bobbin after the winding has been completed, and a problem arises in that a winder cannot automatically connect wires.

SUMMARY OF THE INVENTION

An object of the present invention is to automatically twine (connect) a copper wire serving as the end portion of a secondary winding around a secondary terminal.

As a means for solving the above problem, there is proposed an ignition coil for an internal combustion engine, which comprises a coil portion including a primary winding, a secondary winding and a bobbin around which the secondary winding is wound, a resin case for accommodating the coil portion, a connector for supplying a current to the primary winding of the coil portion, a conductive secondary auxiliary terminal around which the end portion of the secondary winding is twined and fixed to the flange of the bobbin, a conductive secondary terminal confronting with the winding portion of the bobbin and assembled to the secondary auxiliary terminal, and a high tension voltage terminal connected to the secondary terminal for supplying a secondary high tension voltage output to the outside.

With this arrangement, after the secondary winding has been wound, the copper wire serving as the end portion of the secondary winding is automatically twined around the conductive secondary auxiliary terminal. Thereafter, the secondary terminal to which the high tension voltage terminal is connected is connected to the secondary auxiliary terminal connected to the copper wire, whereby the secondary winding is connected to the high tension voltage terminal through the secondary auxiliary terminal and the secondary terminal.

BRIEF DESCRIPTION OF DRAWINGS

FIG. 11 is an exploded front view showing the state before a spring is assembled to a conductive member of the embodiment shown in FIG. 8;

FIG. 12 is a front view showing the state after the spring has been assembled to the conductive member shown in FIG. 11;

BRIEF DESCRIPTION OF THE PREFERRED EMBODIMENTS

Preferred embodiments of the present invention will be described below with reference to the attached drawings.

Figure 1:
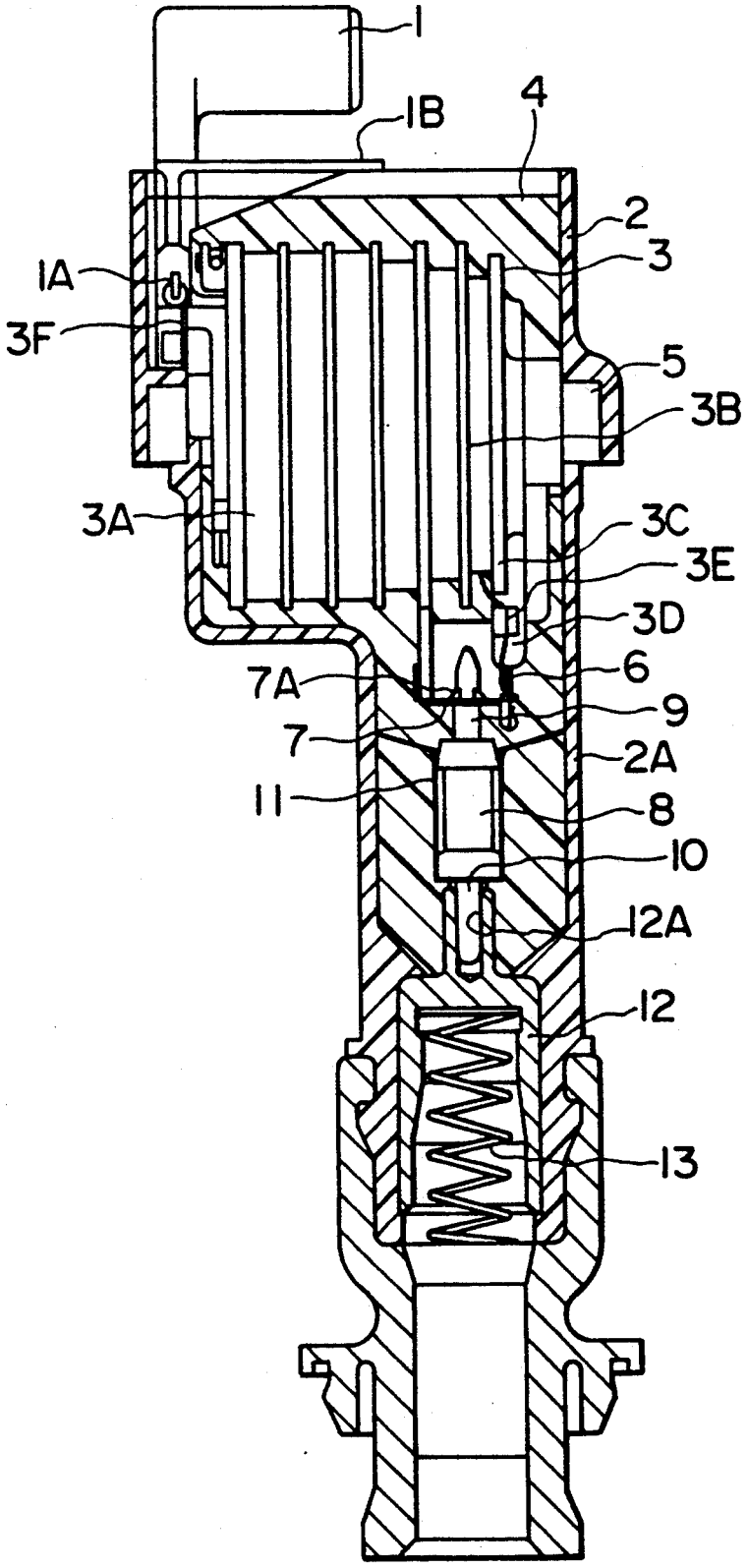
FIG. 1 is a cross sectional view showing a first embodiment of an ignition coil for an internal combustion engine according to the present invention.

FIG. 1 is a cross sectional view showing a first embodiment of the ignition coil according to the present invention, wherein numeral 1 designates a connector having a pair of conductive metal fittings 1A integrally formed therein; numeral 1B designates a plate integrally formed with the connector 1 for preventing a resin material from adhering to the connector 1; numeral 3 designates a coil portion including a primary winding (not shown), a secondary winding 3A and a bobbin 3B having a plurality of winding grooves around which the secondary winding 3A is wound, the primary winding being wound around an iron core 5 concentrically with the secondary winding 3A; numeral 2 designates a resin case for laterally accommodating the coil portion 3, the resin case 2 having a cylindrical portion 2A integrally formed therewith at the lower portion thereof and a cap-shaped high tension voltage terminal 12 being fixedly disposed at the lower portion in the cylindrical portion 2A; numeral 3F designates a copper wire serving as the end portion of the primary winding to be connected to the metal fitting 1A; numeral 3C designates a bobbin flange formed at the edge of the bobbin 3B integrally therewith; numeral 3D designates a projection extending to the outside diameter direction of the bobbin flange 3C and integrally formed therewith, an L-shaped projection 3E being formed on the projection 3D integrally therewith and a copper wire being hooked thereto; numeral 4 designates a thermosetting resin material to be injected into the resin case 2 for fixing the coil portion 3; numeral 6 designates a conductive secondary auxiliary terminal force-fit into a hole (not shown) defined by the projection 3D and fixed thereto, the extreme end of the secondary auxiliary terminal extending beyond the bobbin flange 3C in the diameter direction thereof; numeral 7 designates a conductive secondary terminal assembled to the secondary auxiliary terminal 6 by being engaged therewith, the secondary terminal 7 being disposed in confrontation with the winding portion of the bobbin 3B; numeral 9 designates one terminal of a radio noise prevention resistor 8 which is force-fitted into a hole defined at the center of the secondary terminal 7 and electrically connected to a projection 7A provided at the circumferential edge of the hole; numeral 10 designates the other terminal of the resistor 8 which is force-fitted into and fixed to the upper end hole 12A of a cap-shaped high tension voltage terminal 12, a spring 13 electrically connected to an ignition plug (not shown) being accommodated in the cap-shaped high tension voltage terminal 12; and numeral 11 designates a rib formed in the cylindrical portion 2A integrally therewith to vertically hold the resistor 8 therein.

Figure 2:
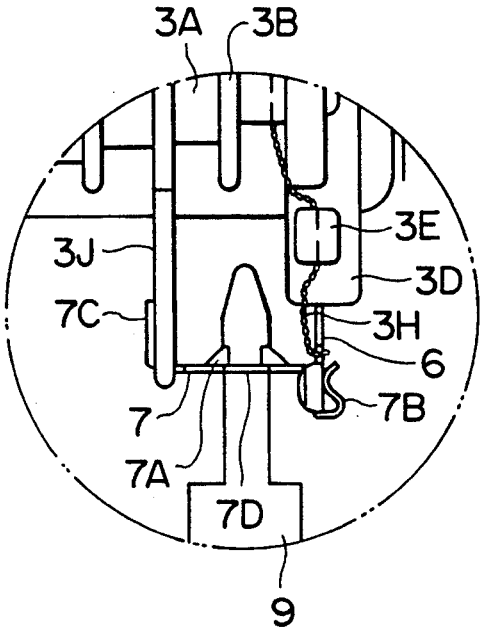
FIG. 2 is an enlarged diagram of the main part of FIG. 1 showing a secondary terminal.
Figure 3A:
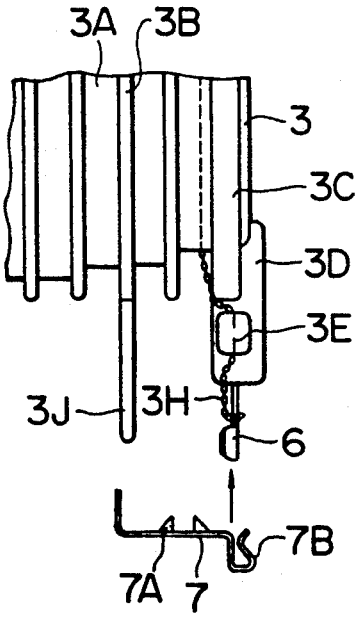
FIG. 3A is an enlarged front view of the secondary terminal.
Figure 3B:
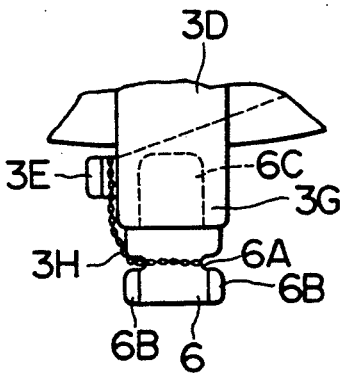
FIG. 3B is a side view of the secondary terminal.
Figure 3C:
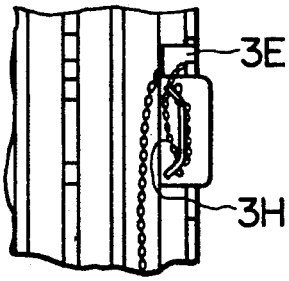
FIG. 3C is a bottom view of the secondary terminal.

FIG. 2 is an enlarged front view showing the structure of the secondary terminal 7 and FIGS. 3A, 3B, and 3C are enlarged views showing how the secondary auxiliary terminal 6 is mounted.

The aforesaid secondary terminal 7 comprises a metal plate having a U-shaped engagingly connecting portion 7B, an L-shaped plate portion 7C horizontally extending from the connecting portion 7B and then bent upward at a right angle, a hole 7D defined substantially at the center of the horizontally extending portion of a L-shaped plate portion 7C, and the projection 7A provided at the circumferential edge of the hole 7D.

The engagingly connecting portion 7B is assembled to the secondary auxiliary terminal 6 by being put thereinto. Further, at this time, the L-shaped plate portion 7C is hooked to a projection bar 3J extending from the extreme end of the groove defined in the bobbin 3B in the direction perpendicular to the bobbin axis. The secondary terminal 7 is fixed so that it is in parallel with the bobbin axis. The one terminal 9 of the resistor 8 is force-fit into the hole 7D and electrically connected to the conductive projection 7A provided at the circumferential edge of the hole 7D.

The secondary auxiliary terminal 6 is a metallic flat plate having a shape shown in FIG. 3(B), and comprises a bent portion 6B, a recessed portion 6A, and a force-fit portion 6C. The secondary auxiliary terminal 6 is fixed to the projection 3D by force-fitting the force-fit portion 6C into the hole 3G defined by the projection 3D integrally formed with the flange 3C. Further, a copper wire 3H serving as the end portion of the secondary winding 3A is hooked to the L-shaped projection 3E integrally formed with the projection 3D and hooked to the recessed portion 6A.

A method of assembling the ignition coil of the present invention will be described. First, the one terminal 10 of the radio noise prevention resistor 8 is force-fitted into the upper end hole 12A defined at the upper end of the high tension voltage terminal 12.

Figure 4:
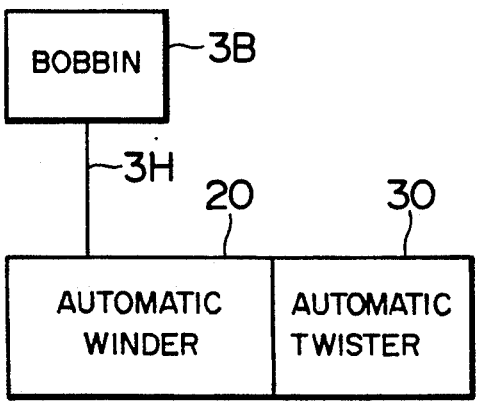
FIG. 4 is a schematic view showing an automatic processing apparatus for the secondary winding of the ignition coil according to the present invention.

Next, as shown in FIG. 4, after the secondary winding 3A has been wound around the bobbin 3B by an automatic winder 20, the copper wire serving as the end portion of the secondary winding 3A is automatically twisted by an automatic twister 30 operating in synchronism with the automatic winder 20. After the twisted copper wire 3H has been hooked to the L-shaped projection 3E by the automatic winder 20, it is twined around the recessed portion 6A of the secondary auxiliary terminal 6. The above process is automatically carried out by the automatic winder 20 and the twister 30. Here, a steel twisted wire twisted by the twister 30 is not always needed. Thereafter, the secondary terminal 7 is assembled to the secondary auxiliary terminal and the copper wire 3H. The secondary auxiliary terminal 6 and the engagingly connecting portion 7B of the secondary terminal 7 are soldered. The thus arranged coil portion 3 is laterally accommodated in the case 2. The other terminal 9 of the resistor 8 is force-fitted into the hole 7D, and electrically connected to the projection 7A provided at the circumferential edge of the hole 7D. Thereafter, the thermosetting resin 4 is vacuum injected through the opening of the resin case 2 to fix the coil portion 3 and the resistor 8.

In addition, the connector 1 is engaged with the coil portion 3 before the coil portion 3 is put into the resin case 2, and the copper wire serving as the end portion of the primary winding is soldered to the metal fitting 1A integrally formed in the connector 1. Here, the plate 1B is integrally formed with the connector 1, and thus when the thermosetting resin 4 is injected into the case 2, place 1B prevents resin from adhering to the connector 1.

Figure 5:
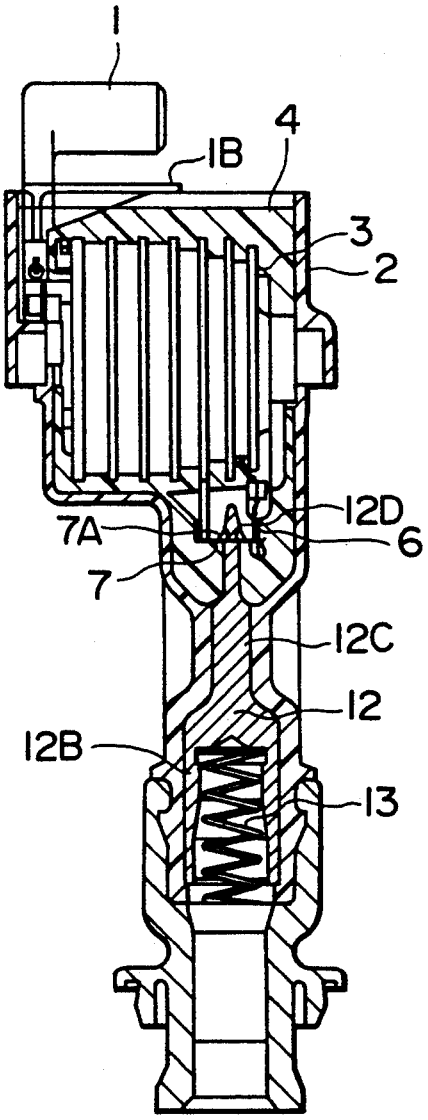
FIG. 5 is a cross sectional view showing a second embodiment of the ignition coil according to the present invention.

A second embodiment of the present invention will be described with reference to FIG. 5.

The second embodiment is different from the first embodiment in that the former does not use the resistor 8 and a high tension voltage terminal 12 is directly connected to a secondary terminal 7. As shown in FIG. 5, the high tension voltage terminal 12 comprises a cap portion 12B for accommodating a spring 13, a column portion 12C vertically extending toward the coil portion 3, and a bar-shaped connecting portion 12D connected to a secondary terminal 7. The connecting portion 12D is force-fit into the hole (not shown) of the secondary terminal 7 and electrically connected to a projection 7A provided at the circumferential edge of the hole to externally output a secondary high tension voltage through the high tension voltage terminal 12.

Figure 6:
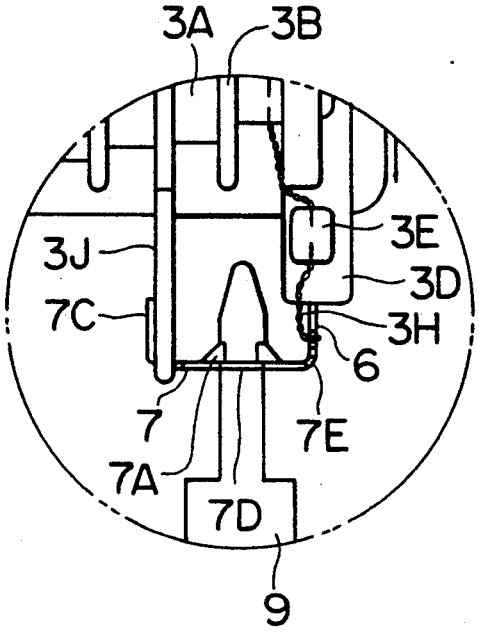
FIG. 6 is a front view showing the main part of a third embodiment of the ignition coil according to the present invention.
Figure 7A:
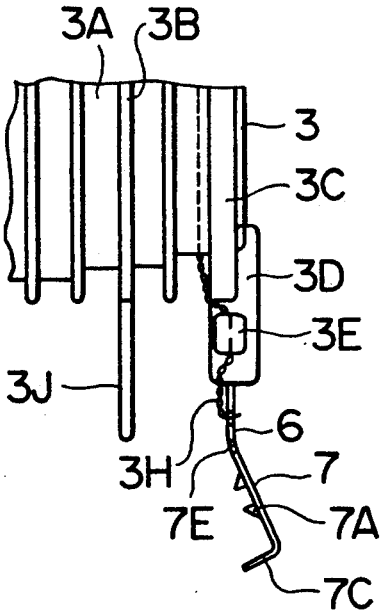
FIG. 7A is a side view of a secondary auxiliary terminal shown in FIG. 6.
Figure 7B:
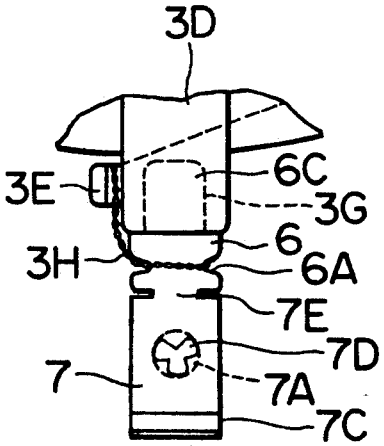
FIG. 7B is a bottom view of the secondary auxiliary terminal shown in FIG. 7A.

A third embodiment of the present invention will be described with reference to FIGS. 6, 7A, and 7B. The third embodiment is different from the first embodiment in that a secondary auxiliary terminal 6, around which a secondary winding 3A is twined, and a secondary terminal (secondary main terminal), connected to a high tension voltage terminal 12, are integrally formed in a shape capable of being bent through a bending recessed portion 7E. The automatic winder (designated as 20 in FIG. 4) automatically winds the secondary winding 3A around the winding portion of the bobbin 3B and twines the end portion of the secondary winding 3A around the secondary auxiliary terminal 6 in the state that both the secondary terminal 7 and the secondary auxiliary terminal 6 do not confront the winding portion of the bobbin 3B. The automatic winder achieves this by slightly bending the secondary terminal 7 to the side opposite of the winding portion of the bobbin 3B, as shown in FIG. 7A. Note the secondary terminal is fixed to the flange 3C of the bobbin 3B. Thereafter, the secondary terminal 7 is bent to the winding portion side of the bobbin 3B and the secondary terminal 7 is caused to confront with the outer circumference of the winding portion of the bobbin 3B.

As described above, according to the present invention, the separation of the secondary auxiliary terminal 6 fixed to the flange 3C of the bobbin from the secondary terminal 7 to be assembled to the secondary auxiliary terminal 6 after the completion of winding provides an excellent advantage in that after the secondary winding 3A has been wound, the copper wire 3H serving as the end portion of the secondary winding can be automatically twined around the secondary auxiliary terminal 6 by the automatic winder 20.

Next, a fourth embodiment of the present invention will be described below with reference to FIG. 8 through FIG. 13, wherein the same numerals used in FIG. 1 through FIG. 7 are used to designate the same parts or corresponding parts.

Figure 8:
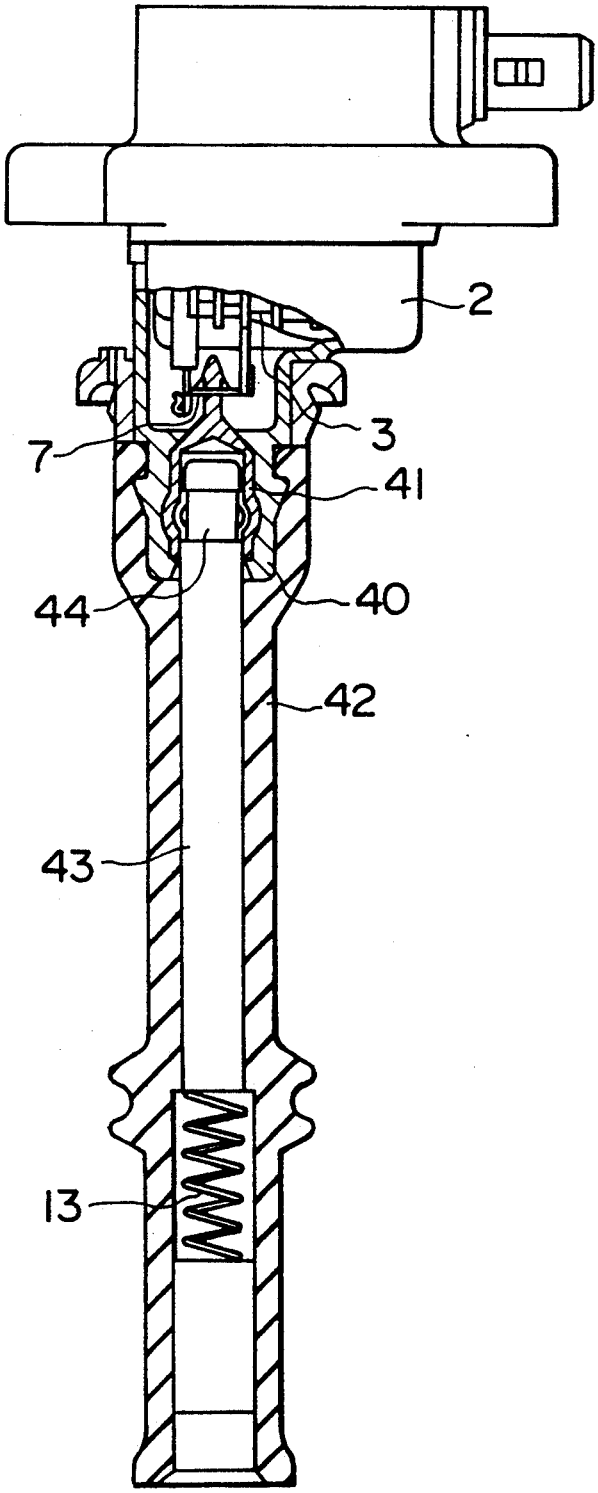
FIG. 8 is a front view, partly in cross section, of a fourth embodiment according to the present invention.

FIG. 8 is a cross sectional view of the main part of the ignition coil for an internal combustion engine according to the fourth embodiment. In this embodiment, a cylindrical high tension tower 40 is integrally formed with the resin case 2 at the lower portion thereof using a resin material. A cap-shaped high tension voltage terminal 41 is fixed in the interior of the high tension voltage terminal 40. The high tension voltage terminal 41 is connected to a secondary terminal 7 to which a copper wire serving as the end portion of a secondary winding is connected. Numeral 42 designates a cylindrical insulating resin member composed of an elastic material such as rubber. A cylindrical conductor 43 is intimately engaged with the inner circumference thereof. In addition, assembled at the upper end of the conductor 42 is a ring spring 44 composed of a conductive metal material and to which the high tension voltage terminal 41 is connected. A coil spring 13 to be directly connected to an ignition coil (not shown) is accommodated at the lower end of the conductor 43. In addition, a space into which a high tension tower 40 is inserted is defined at the portion confronting the ring spring 44 of the inner circumference at the upper end of the insulating resin member 42.

Figure 9:
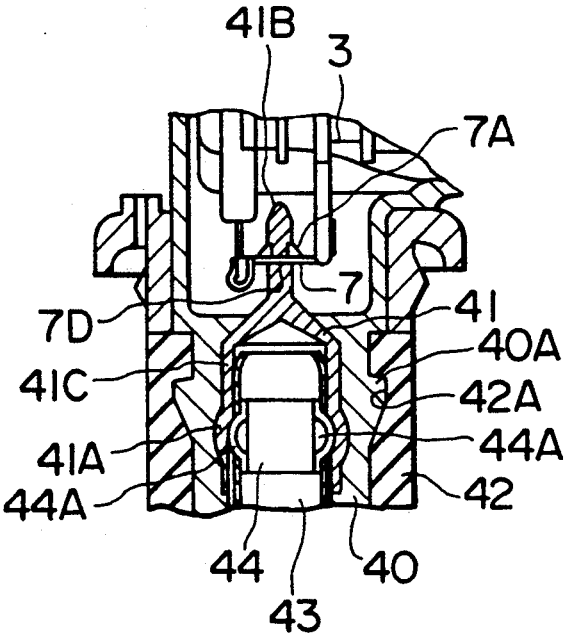
FIG. 9 is an enlarged cross sectional view of the main part of FIG. 8.

FIG. 9 is an enlarged diagram showing the connecting portion where the high tension voltage terminal 41 is connected to the ring spring 44 in the above ignition coil.

Numeral 42A shows a ring-shaped recessed portion provided around the inner circumference at the upper end of the cylindrical insulating resin material 42. The cross section of the recessed portion 42A in the axial direction of the insulating resin member 42 is formed in a trapezoid shape, as shown in FIG. 2. Numeral 40A designates a ring-shaped projection defined around the outer circumference of the high tension tower 40 integral therewith. The cross section of the projection 40A formed to the same trapezoid shape as that of the recessed portion 42A and the projection 40A and the recessed portion 42A being intimately engaged with each other. The high tension voltage terminal 41 has a cap portion 41C and a bar-shaped projection 41B extending from the upper end of the cap portion 41C. The projection 41B is force-fit into the hole 7D defined at the center of the secondary terminal 7 and electrically connected to a projection 7A provided at the circumferential edge of the hole 7D. Numeral 41A designates a ring-shaped recessed portion spherically formed around the inner circumference at the center of the cap portion 41C. The recessed portion 41A is slidably engaged with a plurality of hemispherical metal projections 44A struck out from the outer circumference of the ring spring 44 to electrically connect the high tension voltage terminal 41 to the ring spring 44.

Figure 10:
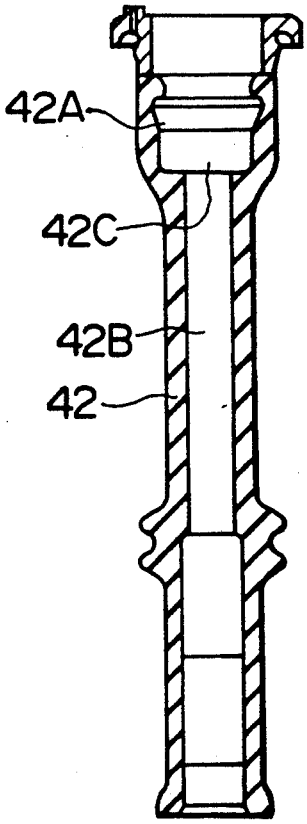
FIG. 10 is a cross sectional view of an insulating resin member of the embodiment shown in FIG. 8.

FIG. 10 is a cross sectional view of the insulating resin member 42, and FIG. 11 is an exploded diagram showing the state before the ring spring 44 and the coil spring 13 are assembled to the conductor 43. FIG. 12 is a diagram showing the state after the ring spring 44 and the coil spring 13 are assembled to the conductor 43. A plurality of through holes 43A are defined around the circumference at the upper end of the cylindrical conductor 43. The projections 44A of the ring spring 44 are force-fit through the opening 43C at the upper end of the conductor 43 and engage with the holes 43A. The projections 44A project to the outside of the conductor 43 through the holes 43A. Numeral 43B designates a cap-shaped accommodating portion integrally formed with the conductor 43 for accommodating the spring 13. Numeral 43D designates a projection struck out from the inner circumference of the conductor 43 to prevent the coil spring 13 from falling down therefrom. Numeral 42B designates a cylindrical hollow portion defined by the insulating member 42 for accommodating the conductor 43 which is intimately engaged therewith. Numeral 42C designates the upper end of the hollow portion 42B serving as an accommodating portion for accommodating the high tension tower 40.

Figure 13:
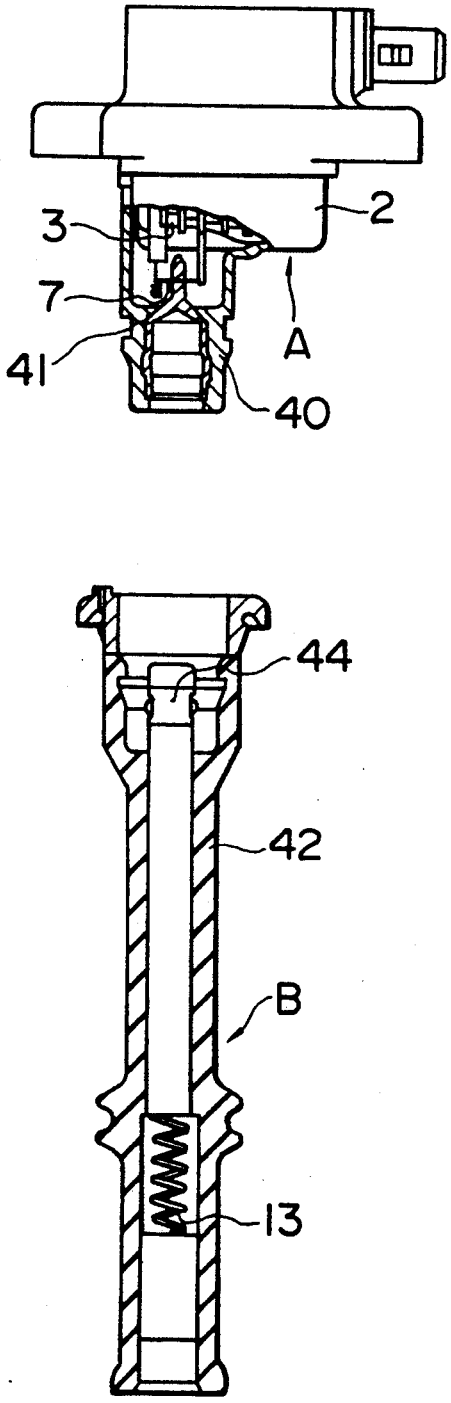
FIG. 13 is an exploded front view, partly in cross section, showing the state in which the conductive member is assembled to an ignition coil portion main body.

FIG. 13 is a diagram showing the state before a connector portion B is assembled to a coil portion main body A. The coil portion main body A including the coil portion 3 producing a high tension voltage, the high tension voltage terminal 41 supplying the high tension voltage, and the like. The connector portion B including the conductor 43 assembled to the coil portion main body A for supplying the high tension voltage, the spring 13 connected to the ignition plug, and the like.

Figure 14:
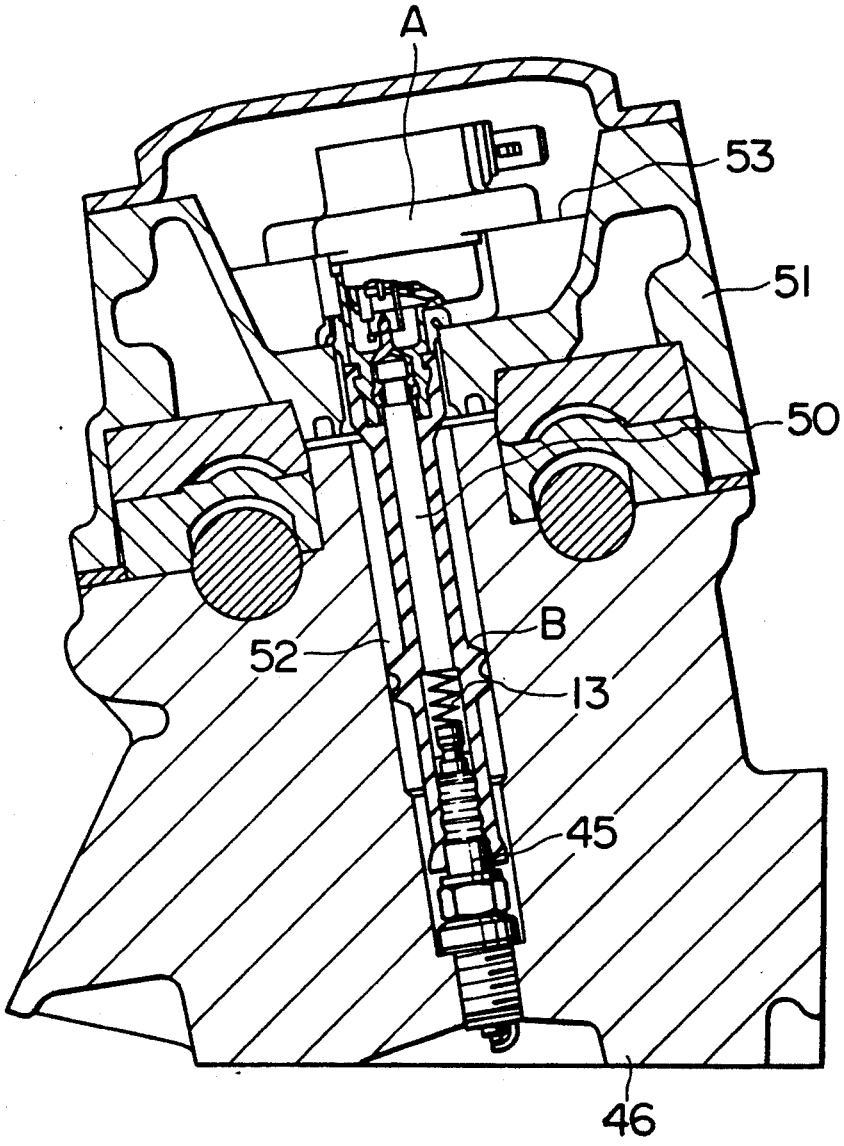
FIG. 14 is a cross sectional view of the main part of an engine to which the ignition coil according to the present invention is assembled.

FIG. 14 is a cross sectional view of a main part showing the state that an ignition coil 50 is assembled to an engine main body 51, wherein numeral 45 designates the ignition plug connected to the coil spring 13, each one of the ignition plugs being provided with each cylinder 46 of a double-overhead-cam type four cycle engine. The ignition coil 50 comprising the coil portion main body A and the connector portion B is fixedly accommodated in a plug hole 52. A coil fixing portion 53 is defined to the engine main body 51 to assemble and fix the coil portion main body A.

A method of assembling the ignition coil 50 arranged as described above will be described below. The coil portion 3 is accommodated in the resin case 2. Further, as described with respect to the first and second embodiments, before the coil portion 3 is accommodated, the secondary terminal 7, to which the copper wire serving as the end portion of the secondary winding 3A is connected, is fixed to the bobbin flange 3C of the coil portion 3. Then, when the coil portion 3 is accommodated in the resin case 2, the projection 41B of the high tension voltage terminal 41 is force-fit into the hole 7D defined at the center of the secondary terminal 7, and the projection 7A provided at the circumferential edge of the hole 7D is electrically connected to the projection 41B. Next, the thermosetting resin is injected between the coil portion 3 and the resin case 2 through the opening (not shown) of the resin case 2 to fix the coil portion.

Further, as described above, the high tension tower 40 is formed to the cylindrical shape and the ring-shaped projection 40A is defined around the outer circumference at the center thereof. The cap 41C of the high tension voltage terminal 41 fixed to the inner circumference of the high tension tower 40 is formed to have the spherical recessed portion 41A around the inner circumference thereof.

The coil portion main body is assembled by the above processes.

Next, the ring spring 44 is force-fit through the opening 43C defined at the upper end of the cylindrical conductor 43 and a plurality of the projections 44A provided around the outer circumference of the ring spring 44 are caused to be engaged with a plurality of the holes 43A defined at the upper end of the conductor 43. Then, the projections 44A are projected to the outside of the outer circumference of the conductor 43 through the holes 43A, so that the ring spring 44 is fixed in the cylinder of the conductor 42. In addition, the coil spring 13 to be connected to the ignition coil 45 is inserted into and accommodated in the cap portion 43B at the lower end of the conductor 43. Then, the connector portion B is provided by causing the conductor 43 comprising the ring spring 44 and the spring 13 to be intimately engaged with the interior of the insulating member.

Next, the connector portion B is inserted into the coil portion main body A. At this time, the recessed portion 42A of the insulating resin member 42 is intimately engaged with the projection 40A of the high tension tower 40, so that the insulating resin member 42 is assembled to the high tension tower 40. More specifically, the connector portion B is assembled to the coil portion main body A. In addition, at this time, a plurality of the hemispherical projections 44A of the ring spring 44 projecting from the holes 43A of the conductor 53 are engaged with the spherical recessed portion 41A provided around the inner circumference of the high tension voltage terminal 41. A biasing force of the ring spring 44 is applied to the projections 44A, and thus the projections 44A are pressed against the recessed portion 41A of the high tension voltage terminal 41, so that the hemispherical projections 44A are electrically connected to the spherically recessed portion 41A in a slidable condition.

The ignition coil for an internal combustion engine of the present invention is assembled by the processes as described above, as shown in FIG. 14.

The coil fixing portion 53 for fixing the coil portion main body A is designed to enable the high tension tower 40 (high tension voltage terminal 41) of the coil portion main body A to be concentrically aligned with the axis of the ignition plug 45.

Incidentally, if the high tension tower 40 is not concentrically aligned with the axis of the ignition plug 45 due to a manufacturing error or the like of an engine, misalignment is caused between the coil portion main body A and the connector portion B when the ignition coil 50 is accommodated in the engine main body 51. However, since hemispherical projections 44A are electrically connected to the spherical recessed portion 41A in the slidable condition, the misalignment is absorbed at the connecting portion, and thus there is no possibility that the former comes into insufficient contact with the latter. In addition, there is no possibility that an insufficient contact is caused by the vibration of the engine.

Note that a plurality of hemispherical projections are integrally provided with the conductor 43 in place of the ring spring 44. In addition, the projections provided with the conductor 43 need not be formed in a hemispherical shape but may be formed in any shape such as a conical shape or the like.

As described above, according to the fourth embodiment of the ignition coil for an internal combustion engine according to the present invention, the above excellent advantage can be provided in addition to the advantages provided by the aforesaid first, second and third embodiments.

More specifically, according to this embodiment, since the coil portion main body is assembled to the connector portion by causing the projection of the high tension tower to be engaged with the recessed portion of the insulating resin member, the coil portion main body is difficult to get out of the connector portion. Since the projections provided with the conductor are engaged with the spherical recessed portion of the high tension terminal, the former is electrically connected to the latter even if the conductor is moved. The spherical recessed portion always contact with the projections, and thus an insufficient contact between the conductor and the ring spring can be prevented, whereby a high tension voltage can be securely supplied to the ignition plug.

What is claimed is:

1. An ignition coil for an internal combustion engine, comprising:

a coil portion including a primary winding, a secondary winding and a bobbin around which said second winding is wound;

a resin case for accommodating said coil portion;

a connector for supplying a current to said primary winding of said coil portion;

a conductive secondary auxiliary terminal around which an end portion of said secondary winding is twined, said secondary auxiliary terminal being fixed to a flange of said bobbin and extending radially therefrom, with respect to said coil portion, a conductive secondary terminal opposing the winding portion of said bobbin and connected to said secondary auxiliary terminal; and a high tension voltage terminal connected to said secondary terminal for supplying a secondary high tension voltage.

2. An ignition coil for an internal combustion engine, comprising:

a coil portion including a primary winding, a secondary winding and a bobbin around which said secondary winding is wound;

a resin case for accommodating said coil portion;

a connector for supplying a current to said primary winding of said coil portion;

a conductive secondary auxiliary terminal around which an end portion of said secondary winding is twined, said secondary auxiliary terminal being fixed to a flange of said bobbin;

a conductive secondary terminal opposing the winding portion of said bobbin and connected to said secondary auxiliary terminal; and a high tension voltage terminal connected to said secondary terminal for supplying a secondary high tension voltage;

wherein a radio noise prevention resistor is interposed between said secondary terminal and said high tension voltage terminal, said secondary terminal defining a hole into which a terminal of said resistor is force-fit.

3. An ignition coil for an internal combustion engine, comprising:

a coil portion including a primary winding, a secondary winding and a bobbin around which said secondary winding is wound;

a resin case for accommodating said coil portion;

a connector for supplying a current to said primary winding of said coil portion;

a conductive secondary auxiliary terminal around which an end portion of said secondary winding is twined, said secondary auxiliary terminal being fixed to a flange of said bobbin;

a conductive secondary terminal opposing the winding portion of said bobbin and connected to said secondary auxiliary terminal; and a high tension voltage terminal connected to said secondary terminal for supplying a secondary high tension voltage;

wherein a bar-shaped connecting portion is integrally formed with said high tension voltage terminal, said secondary terminal defining a hole into which said connected portion is force-fit.

4. An ignition coil for an internal combustion engine, comprising:

a coil portion including a primary winding, a secondary winding and a bobbin around which said secondary winding is wound;

a resin case for accommodating said coil portion;

a connector for supplying a current to said primary winding of said coil portion;

a conductive secondary auxiliary terminal around which an end portion of said secondary winding is twined, said secondary auxiliary terminal being fixed to a flange of said bobbin;

a conductive secondary terminal opposing the winding portion of said bobbin and connected to said secondary auxiliary terminal; and a high tension voltage terminal connected to said secondary terminal for supplying a secondary high tension voltage;

wherein said resin case has an opening, said connector is disposed at the opening of said resin case, a resin plate covers a part of the opening of said resin case and is integrally formed with said connector, and a thermosetting insulating resin is injected into said resin case through the opening thereof.

5. An ignition coil for an internal combustion engine, comprising:

a coil portion including a primary winding, a secondary winding and a bobbin around which said secondary winding is wound;

a resin case for accommodating said coil portion;

a connector for supplying a current to said primary winding of said coil portion;

a conductive secondary auxiliary terminal around which an end portion of said secondary winding is twined, said secondary auxiliary terminal being fixed to a flange of said bobbin;

a conductive secondary terminal opposing the winding portion of said bobbin and connected to said secondary auxiliary terminal; and a high tension voltage terminal connected to said secondary terminal for supplying a secondary high tension voltage;

wherein said secondary terminal has an engagingly connecting portion for connecting to said secondary auxiliary terminal by engaging said second auxiliary terminal.

6. An ignition coil for an internal combustion engine according to claim 5, wherein said bobbin has a plurality of winding grooves around which said secondary winding is wound, a projection extends radially from an extreme end of one of the grooves, and said secondary terminal has a first end coupled to said secondary auxiliary terminal through said engagingly connecting portion and a second end is coupled to said projection.

7. An ignition coil for an internal combustion engine, comprising:

a coil portion including a primary winding, a secondary winding and a bobbin around which said secondary winding is wound;

a resin case for accommodating said coil portion;

a connector for supplying a current to said primary winding of said coil portion;

a conductive secondary auxiliary terminal around which an end portion of said secondary winding is twined, said secondary auxiliary terminal being fixed to a flange of said bobbin;

a conductive secondary terminal opposing the winding portion of said bobbin and connected to said secondary auxiliary terminal;

a high tension voltage terminal connected to said secondary terminal for supplying a secondary high tension voltage;

a cylindrical high tension tower integrally formed with said resin case using a resin, a high tension voltage terminal fixed in the cylinder of said high tension tower and electrically connected to said secondary terminal, said high tension voltage terminal having a spherical recessed portion around the inner circumference thereof, a cylindrical insulating member composed of an elastic material, a cylindrical conductor engaged within the interior of said insulating member, projections being formed on an outer circumference of said conductor at a first end thereof, and a coil spring accommodated in a second end of said conductor for being connected to an ignition plug, wherein said high tension tower is engaged with said insulating member, and said projections of said conductor are slidingly engaged with said spherical recessed portion of said high tension voltage terminal.

8. An ignition coil for an internal combustion engine, comprising:

a coil portion main body comprising a coil portion including a primary winding, a secondary winding and a bobbin, said bobbin having a winding portion around an outer circumference of which said secondary winding is wound and a flange portion, a resin case for accommodating said coil portion, a conductive secondary auxiliary terminal to which an end portion of said secondary winding is twined and fixed to said flange portion of said bobbin, a conductive secondary terminal opposing an outer circumference of said winding portion of said bobbin and coupled to said secondary auxiliary terminal, a cylindrical high tension tower integrally formed with said resin case using a resin, and a high tension voltage terminal fixed within the cylinder of said high tension tower and electrically connected to said secondary terminal, said high tension voltage terminal having a spherical recessed portion around an inner circumference thereof;

a high tension connector portion including a cylindrical insulating resin member composed of an elastic material, a cylindrical conductor engaged within the interior of said insulating resin member, projections formed on an outer circumference of said conductor at a first end thereof, and a coil spring accommodated in a second end of said conductor for being connected to an ignition plug; and wherein said high tension connector portion is connected to said coil portion main body by causing said high tension tower to be engaged with said insulating resin member, and said projections of said conductor are slidably engaged with said spherical recessed portion of said high tension voltage terminal.

9. A method of manufacturing an ignition coil for an internal combustion engine, said coil having a coil portion including a primary winding, a secondary winding, and a bobbin having at an outer circumference thereof a winding portion around which said secondary winding is wound, a high tension voltage terminal disposed at a position opposing the winding portion of said bobbin for supplying a secondary high tension output, and a secondary terminal for connecting said high tension voltage terminal to said secondary winding, said manufacturing method comprising the steps of:

fixing said secondary terminal to said bobbin so that said secondary terminal does not oppose the winding portion of said bobbin;

automatically winding said secondary winding around the winding portion of said bobbin and automatically twining an end portion of said secondary winding to said secondary terminal in a continuous operation by an automatic winder;

disposing a connecting portion, where said secondary terminal is to be connected to said high tension voltage terminal, so that said connecting portion opposes the outer circumference of the winding portion of said bobbin; and connecting said high tension voltage terminal to said connecting portion.

10. A method of manufacturing an ignition coil for an internal combustion engine, said coil having a coil portion including a primary winding, a secondary winding, and a bobbin having at an outer circumference thereof a winding portion around which said secondary winding is wound, a high tension voltage terminal disposed at a position opposing the winding portion of said bobbin for supplying a secondary high tension output, and a secondary terminal for connecting said high tension voltage terminal to said secondary winding, said secondary terminal is separated into a secondary auxiliary terminal, to which an end portion of said secondary winding is twined, and a secondary main terminal, which is connected to said high tension voltage terminal, said manufacturing method comprising the steps of:

fixing said secondary auxiliary terminal to said bobbin so that said secondary auxiliary terminal does not oppose the winding portion of said bobbin;

automatically winding said secondary winding around the winding portion of said bobbin and automatically twining an end portion of said secondary winding to said secondary auxiliary terminal in a continuous operation by an automatic winder;

connecting said secondary main terminal to said secondary auxiliary terminal so that said secondary main terminal opposes the outer circumference of the winding portion of said bobbin; and connecting said high tension voltage terminal to a connecting portion of said second main terminal.

11. A method of manufacturing an ignition coil for an internal combustion engine, said coil having a coil portion including a primary winding, a secondary winding, and a bobbin having at an outer circumference thereof a winding portion around which said secondary winding is wound, a high tension voltage terminal disposed at a position opposing the winding portion of said bobbin for supplying a secondary high tension output, and a secondary terminal for connecting said high tension voltage terminal to said secondary winding, said secondary terminal being integrally formed of a secondary auxiliary terminal, to which said secondary winding is twined, and a secondary main terminal, which is connected to said high tension voltage terminal, said secondary auxiliary terminal and said secondary main terminal are formed to a shape capable of being bent, said manufacturing method comprising the steps of:

fixing said secondary terminal to said bobbin so that neither said secondary auxiliary terminal nor said secondary main terminal opposes the winding portion of said bobbin;

automatically winding said secondary winding around the winding portion of said bobbin and automatically twining an end portion of said secondary winding to said secondary auxiliary terminal by an automatic winder;

bending said secondary terminal so that said secondary main terminal opposes the outer circumference of the winding portion of said bobbin; and connecting said high tension voltage terminal to said secondary main terminal.

* * * * *